US007377869B2

(12) United States Patent
Wohlfeil et al.

(10) Patent No.: US 7,377,869 B2
(45) Date of Patent: May 27, 2008

(54) MECHANICAL ANTI-WEDGING AND CONTROLLED DEPLOYMENT BROADHEAD

(76) Inventors: Bryan J Wohlfeil, 1501 Knob Hill, Commerce, MI (US) 48382; Gregg W Palm, 808 Adelaide Dr., Walled Lake, MI (US) 48390-2303; Arshag K Odabachian, 3721 Green Lake Rd., West Bloomfield, MI (US) 48324

( * ) Notice: Subject to any disclaimer, the term of this patent is extended or adjusted under 35 U.S.C. 154(b) by 72 days.

(21) Appl. No.: 10/989,938

(22) Filed: Nov. 16, 2004

(65) Prior Publication Data

US 2005/0130774 A1 Jun. 16, 2005

Related U.S. Application Data

(60) Provisional application No. 60/520,707, filed on Nov. 17, 2003.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 2,568,417 A * 9/1951 Steinbacher ..... 473/583
2,820,634 A * 1/1958 Vance ..... 473/583
5,078,407 A * 1/1992 Carlston et al. ..... 473/583
5,458,341 A * 10/1995 Forrest et al. ..... 473/583
6,398,676 B1 * 6/2002 Mizek ..... 473/583
6,517,454 B2 * 2/2003 Barrie et al. ..... 473/583
6,595,881 B1 * 7/2003 Grace et al. ..... 473/583

* cited by examiner

*Primary Examiner*—John Ricci
(74) *Attorney, Agent, or Firm*—Harness, Dickey & Pierce, PLC

(57) ABSTRACT

An anti-wedging, controlled deployment broadhead with an over-center of gravity blade geometry for bow-hunting that has the ability to penetrate bone and soft tissue deeply before deploying its blades while conserving the highest possible amount of kinetic energy in flight and at target. The inventive device includes the one-piece body, specially aligned and faceted cutting tip, blades, O-ring, and set screws. The blades have independent pivots that also act as travel limiters, are arch shaped with very sharp leading edges and a J-shaped lever. The center of gravity of each of the blades is oriented so as to insure retaining each blade in its respective retracted position during acceleration and assisting in deployment thereof during deceleration. The device with its special body and blade geometry now allows for more energy and blade area to be delivered to the vital organs of game to facilitate a faster and more humane harvest.

70 Claims, 4 Drawing Sheets

MECHANICAL ANTI-WEDGING AND CONTROLLED DEPLOYMENT BROADHEAD

CROSS-REFERENCE TO RELATED APPLICATIONS

This application claims the benefit of U.S. Provisional Application No. 60/520,707 filed on Nov. 17, 2003. The disclosure of the above application is incorporated herein by reference.

FIELD OF THE INVENTION

The present invention relates generally to bowhunting arrow tips and more specifically it relates to a mechanical anti-wedging and controlled deployment broadhead for providing a bow-hunting broadhead that has the ability to penetrate bone and soft tissue deeply and without "wedging" in the hole created by the tip, before deploying its cutting blade in a controlled manner while conserving the highest possible amount of kinetic energy.

BACKGROUND OF THE INVENTION

It can be appreciated that bowhunting arrow tips have been in use for years. Typically, bowhunting arrow tips are comprised of broadheads like the Vortex 100-125, Rocky Mountain Snyper, Sonoran 100-125, NAP Spiffire 100-125, Rockets Steelheads 100-125, Wasps Jackhammer 100-125, Game Tracker Silvertip 100, and Ironheads Expandables.

The main problem with conventional bowhunting arrow tips are the amount of penetration before blade deployment is insufficient to allow these broadheads to penetrate below-the-surface hard objects (such as hunted animal's ribs and shoulder blades) and then deploy the cutting blades. This results in very poor penetration, a high probability for deflection, a high probability for catapulting and needlessly wounding game that cannot be recovered by the hunter. Another problem with conventional bowhunting arrow tips are the high level of deflection due to the design opens on contact and/or exposed blade actuation. Unless the shot is perpendicular to the target, this open, or cut-on-contact design flaw allows the broadhead's tip and/or blades to divert or steer the arrow off its course, wasting the kinetic energy that should be used for penetration. Another problem with conventional bowhunting arrow tips are in all other broadhead designs to date, very high levels of wedge exist when the blades are actuated to deploy. This occurs because whatever hole or cavity the tip created on impact is now too small for the rest of the body and/or blades to pass through without wedging. Even with perfect conditions and shot placement, the design flaws consume considerable amounts of the arrow's kinetic energy as frictional heat before some or any penetration occurs. This results in inhumane kills or permanent wounding of game that cannot be recovered by the hunter.

While these devices may be suitable for the particular purpose to which they address, they are not as suitable for providing a bow-hunting broadhead that has the ability to penetrate bone and soft tissue deeply and without wedging in the hole created by the tip, before deploying its cutting blades in a controlled manner while conserving the highest possible amount of kinetic energy. The main problem with conventional bowhunting arrow tips is the amount of penetration before blade deployment is insufficient to allow these broadheads to penetrate below-the-surface hard objects (such as hunted animal ribs and shoulder blades) and then deploy the cutting blades. This results in very poor penetration, a high probability for deflection, a high probability for catapulting and needless wounding game that cannot be recovered by the hunter. Another problem is the high level of deflection due to the design opens on contact and/or exposed blade actuation. Unless the shot is perpendicular to the target, this open, or cut-on-contact design flaw allows the broadhead's tip and/or blades to divert or steer the arrow off its course, wasting the kinetic energy that should be used for penetration. Also, another problem is in all other broadhead designs to date, very high levels of wedge exist when the blades are actuated to deploy. This occurs because whatever hole or cavity the tip created on impact is now too small for the rest of the body and/or blades to pass through without wedging. Even with perfect conditions and shot placement, the design flaws consume considerable amounts of the arrows kinetic energy as frictional heat before some or any penetration occurs. This results in inhumane kills or permanent wounding of game that cannot be recovered by the hunter.

In these respects, the mechanical anti-wedging and controlled deployment broadhead according to the present invention substantially departs from the conventional concepts and designs of the prior art, and in so doing, provides an apparatus primarily developed for the purpose of providing a bow-hunting broadhead that has the ability to penetrate bone and soft tissue deeply and without wedging in the hole created by the tip, before deploying its cutting blades in a controlled manner while conserving the highest possible amount of kinetic energy.

SUMMARY OF THE INVENTION

In view of the foregoing disadvantages inherent in the known types of bowhunting arrow tips now present in the prior art, the present invention provides a new mechanical anti-wedging and controlled deployment broadhead construction wherein the same can be utilized for providing a bow-hunting broadhead that has the ability to penetrate bone and soft tissue deeply and without wedging in the hole created by the tip, before deploying its cutting blades in a controlled manner while conserving the highest possible amount of kinetic energy.

The general purpose of the present invention, which will be described subsequently in greater detail, is to provide a new mechanical anti-wedging and controlled deployment broadhead that has many of the advantages of the bowhunting arrow tips mentioned heretofore and many novel features that result in a new mechanical anti-wedging and controlled deployment broadhead which is not anticipated, rendered obvious, suggested, or even implied by any of the prior art bowhunting arrow tips, either alone or in any combination thereof.

To attain this, the present invention generally comprises the body, blades, O-ring, and set screws. The body is one-piece with an integrated faceted cutting tip. The cutting tip is slightly larger than the main body immediately following the tip. The body has a lengthwise slot, open to two sides that pass through part of it. A groove is cut into the exterior circumference of the body to locate a retainer like an O-ring. Two drilled and tapped holes are placed through the body for locating and holding the blades and are filled with supporting components like the set screws. The body then finishes at the rear with a pilot and then threads to attach to an arrow. The blades are curved and shaped on an arch with very sharp leading edges and a J-shaped lever. The blades each have one hole in them for location and pivot and the rest of the shape is made with multiple complex curves. The O-ring helps hold the blades in only for handling and premature deployment. The set screws retain, act as pivot points, and act as stop points for the blades in both closed and full open positions.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology herein are for the purpose of the description and should not be regarded as limiting.

A primary object of the present invention is to provide a mechanical anti-wedging and controlled deployment broadhead that will overcome the shortcomings of the prior art devices.

An object of the present invention is to provide a mechanical anti-wedging and controlled deployment broadhead for providing a bow-hunting broadhead that has the ability to penetrate bone and soft tissue deeply and without wedging in the hole created by the tip, before deploying its cutting blades in a controlled manner while conserving the highest possible amount of kinetic energy.

Another object is to provide a mechanical anti-wedging and controlled deployment broadhead that gives all bow hunters with varying levels of strength and size, the ability to first penetrate deep into all game, then deploy blades with very large cutting widths. This results in a consistent, humane, fast harvest of game.

Another object is to provide a mechanical anti-wedging and controlled deployment broadhead that mimics the flight characteristics of a smooth, non-bladed field point, to help eliminate flight accuracy problems so all shots hit consistently and accurately.

Another object is to provide a mechanical anti-wedging and controlled deployment broadhead that has an anti-wedging design, so hard-target pass-through (such as bone) is accomplished before deploying the cutting blades. This is to conserve kinetic energy so the broadhead can penetrate further into the target.

Another object is to provide a mechanical anti-wedging and controlled deployment broadhead that has three independent blade deployment actuation devices that also work in concert with each other so that, after penetration, blade deployment reliability is not a factor.

Another object is to provide a mechanical anti-wedging and controlled deployment broadhead that helps eliminate possibility of deflection (ricochet) and catapulting by first penetrating deep, then opening the blades in the game. The ability of this broadhead to anchor its flight path deep into the game before blade deployment helps insure a greatly reduced chance of deflection and allows for less-than-perfect off-axis shots to be taken with confidence.

Another object is to provide a mechanical anti-wedging and controlled deployment broadhead that has a one piece fully machined billet body with an integrated and aligned quad facet cutting tip larger than the body immediately following (to eliminate body wedging), utilizing a Type-III hard-anodized surface. This integrated and aligned tip provides consistent flight characteristics while the Type-III hardcoat increases surface hardness (over twelve times thicker/deeper than standard anodizing), lubricity and abrasion resistance.

Another object is to provide a mechanical anti-wedging and controlled deployment broadhead that severs the tissues and vital organs of the game with very large curved blades designed to conserve forward momentum by using a slicing, not a chopping action. When deployed, the blades have a limited ability to articulate perpendicular to their pivot point. This feature reduces the chances of in-game deflection and blade breakage if the blades encounter hard materials.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1A:
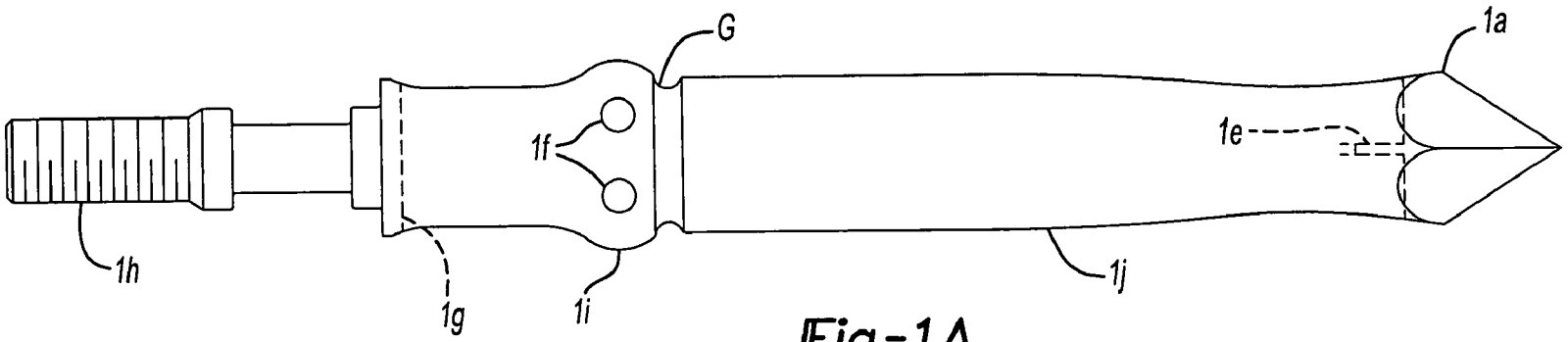
FIGS. 1A and 1B are plan and side views, respectively, of the body.
Figure 1B:
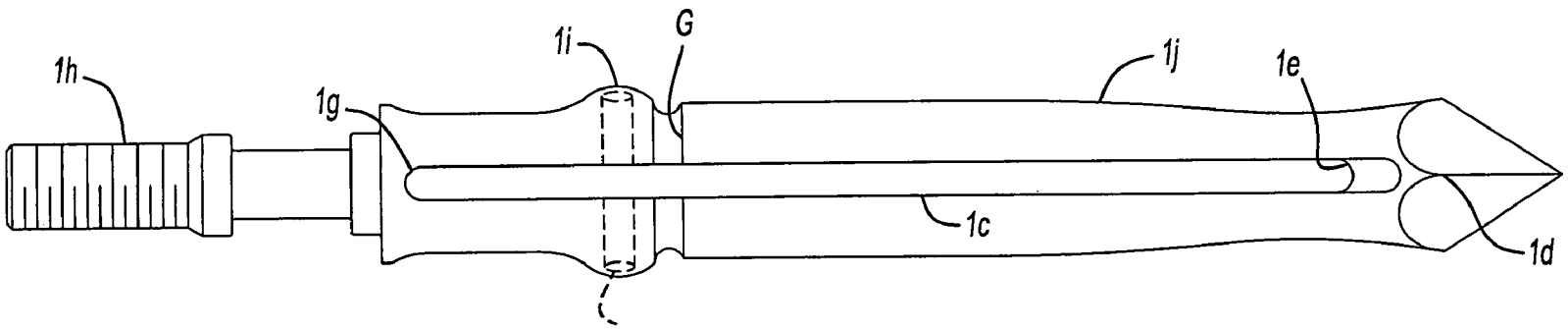

The following description of the preferred embodiment(s) is merely exemplary in nature and is in no way intended to limit the invention, its application, or uses.

Turning now descriptively to the drawings, in which similar reference characters denote similar elements throughout the several views, the attached figures illustrate a mechanical anti-wedging and controlled deployment broadhead, which comprises the body, blades, O-ring and set screws. The body is one-piece with an integrated faceted cutting tip. The cutting tip is slightly larger than the main body immediately following the tip. The body has a lengthwise slot, open to two sides that pass through part of it. A groove is cut into the exterior circumference of the body to locate a retainer like an O-ring. Two drilled and tapped holes are placed through the body for locating and holding the blades and are filled with supporting components like the set screws. The body then finishes at the rear with a pilot and then threads to attach to an arrow. The blades are curved and shaped on an arch with very sharp leading edges and a J-shaped lever. The blades each have one hole in them for location and pivot and the rest of the shape is made with multiple complex curves. The O-ring helps hold the blades in only for handling and premature deployment. The set screws retain, act as pivot points, and act as stop points for the blades in both closed and full open positions.

The body is one-piece with an integrated faceted cutting tip. The cutting tip is slightly larger than the main body immediately following the tip. The body has a lengthwise slot, open to two sides that pass through part of it. A groove is cut into the exterior circumference of the body to locate a retainer like an O-ring. Two drilled and tapped holes are placed through the body for locating and holding the blades and are filled with supporting components like the set screws. The body then finishes at the rear with a pilot and then threads to attach to an arrow. The body is fully machined from a hardened aluminum alloy 6061-T6 or 7075-T6, Type III anodized hard coat and constructed in one piece with an integrated faceted cutting tip. The one-piece construction is to provide the straightest alignment of the cutting surfaces as well as all the components held within. The Type III anodized hard coat creates a very hard and low friction surface. The penetration of this super hard aluminum oxide shell is over 12 times as thick as standard Type II anodize. This level of anodization greatly enhances the abrasion resistance of the body as well as the strength and integrity of the cutting facets on the tip. The design intent of the integrated cutting tip and one-piece body is to provide very consistent airflow, turbulence, and strength, which provide a very accurate and repeatable shooting ability. The tip's 1*a* major diameter is larger than the main body immediately following so that, after penetration of the tip into the target, the rest of the body can pass through with reduced resistance. The tip has four concave machined grooves in it to facilitate fracturing and creation of a hole/cavity of a hard material target. Behind the tip portion of the body is a machined slot 1*c*, clear and open to both sides of the body and oriented 180° through the body. It is aligned with the cutting tip so that two of the four cutting facet edges are in-line, as seen at 1*d*, with the slot. This helps to create both a fracture line in the target that the exposed blades can continue with, and also creates a "bow-wave" of turbulent air under which the exposed portions of the blades and blade levers can fly through with minimal energy loss. At the top of the slot, as seen at 1*e*, well inside the major diameter of the body is a "stop tab" machined and integral to the body material. This stop tab is insurance to guard against any possibility that the opposing blades tips might interlock and hinder deployment. At the bottom of the slot, the slot is terminated with a machined radius 1*g* to strengthen the body as well as further reduce possibilities of stress risers and fractures. A retention groove G is machined into exterior circumference of the body to facilitate the location of an O-ring R or similar device that is used to secure the blades within the slot of the body when the product is assembled and handled. Behind the retention groove are two threaded holes 1*f* that pass completely through the body at 90° to the slot orientation. These threaded holes are filled with fully threaded fasteners S that retain the blade assemblies and also serve to mechanically secure and stabilize the body from collapsing or spreading in the area of the slot 1*c*. In the rear portion of the body, behind where the slot ends, is the portion of the body that screws into an arrows shaft via the arrows (AMO standard) female threads 1*h*. This portion would not be visible when the product is assembled onto an arrow. It is comprised of a shoulder with major and minor diameters and a threaded portion to facilitate a positive stop when screwed into a standard arrow. This section of the body is designed to, and meets the AMO standards set forth by the ATA (Archery Trade Association). The body's geometry and function in the design intent is sound. Changes in overall length/size to produce lighter/heavier versions is planned. Changes to the geometry of the tip and of the cutting surfaces and facets are possible, including a separate tip, as well as a different material or alloy. The geometry of the cutting tips major diameter being larger than the body portion directly following it will most likely not change. Composition of the body may be modified to include, or be made of composites. Altering coatings, materials and/or lubricants (surface or imbedded treatments) to eliminate friction and ways to make the entire body stronger are all possibilities to improve the reliability of the design.

Figure 2:
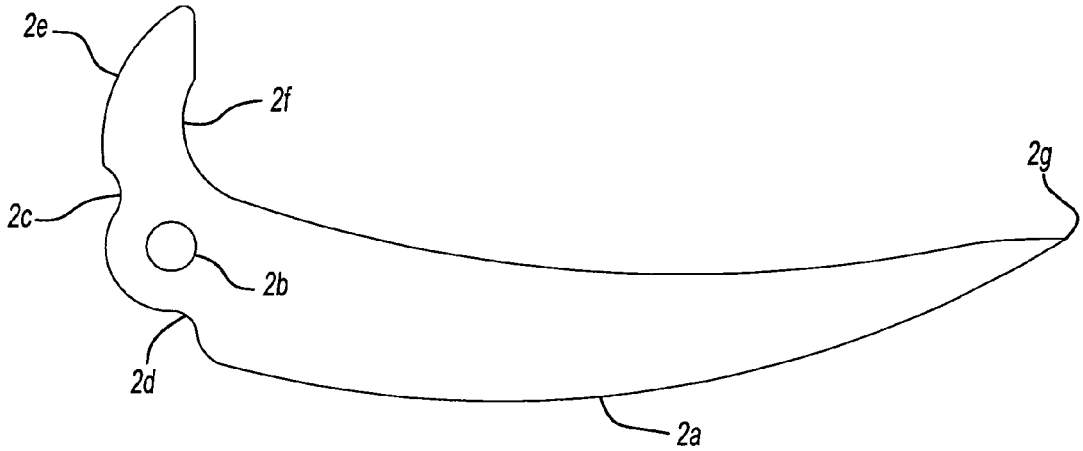
FIG. 2 is a plan view of one of the cutting blades.
Figure 2A:
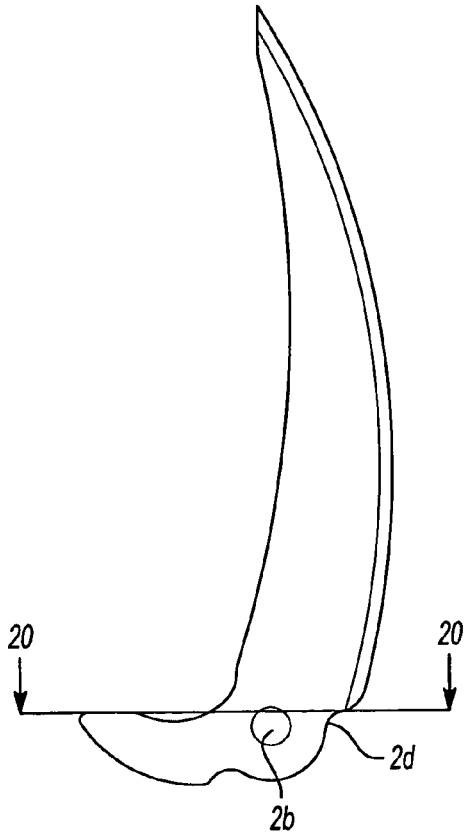
FIG. 2A is a further plan view of one of the cutting blades showing the relationship between the actuating lever with respect to the pivotal axis for the actuating lever.
Figure 3:
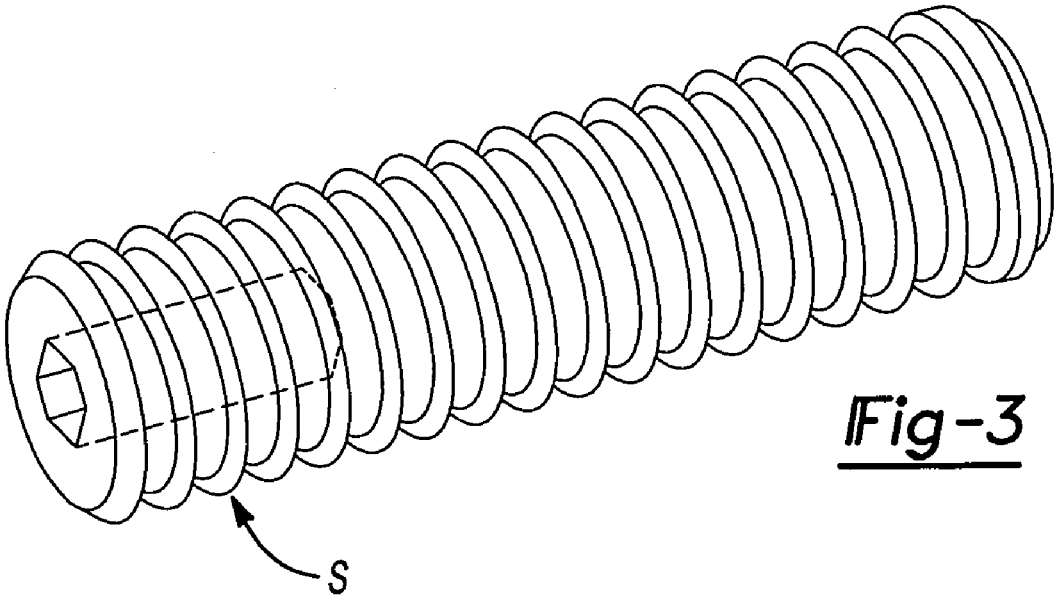
FIG. 3 is an elevated perspective view of one of the set screws utilized for pivotably mounting the cutting blades.
Figure 4:
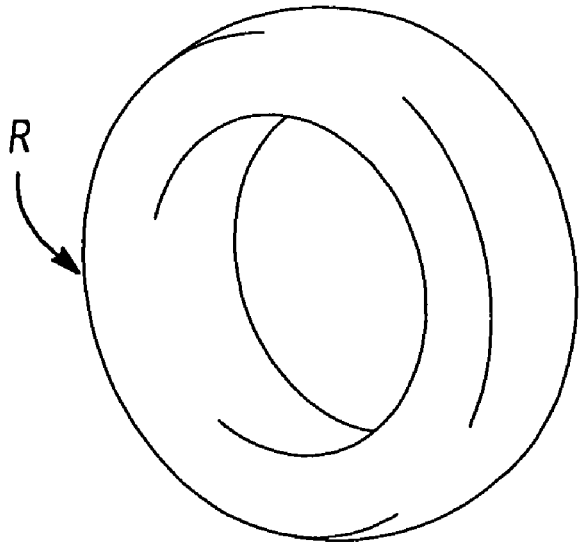
FIG. 4 is an elevated perspective view of the O-ring utilized to prevent premature deployment of the cutting blades.
Figure 5C:
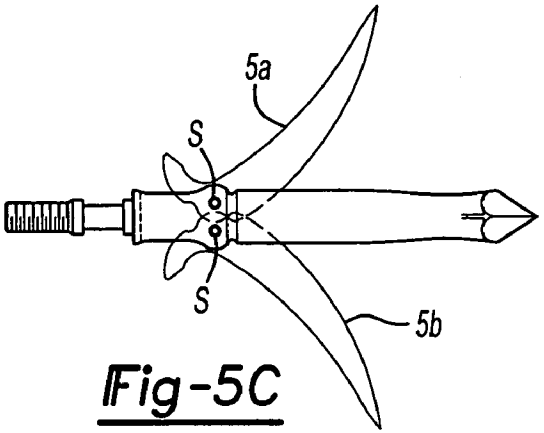
FIGS. 5A-5F are plan views of the body and associated cutting blades, showing the blades in various positions from fully retracted to fully deployed.
Figure 5B:
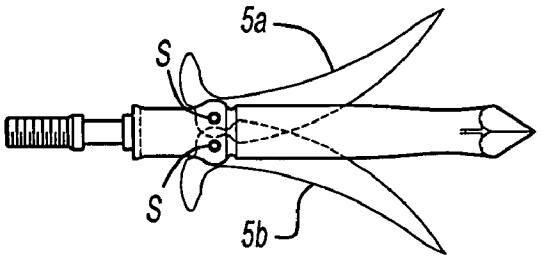
Figure 5A:
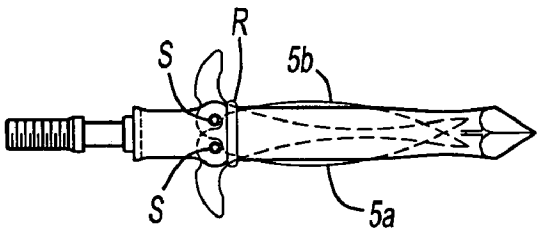
Figure 5F:
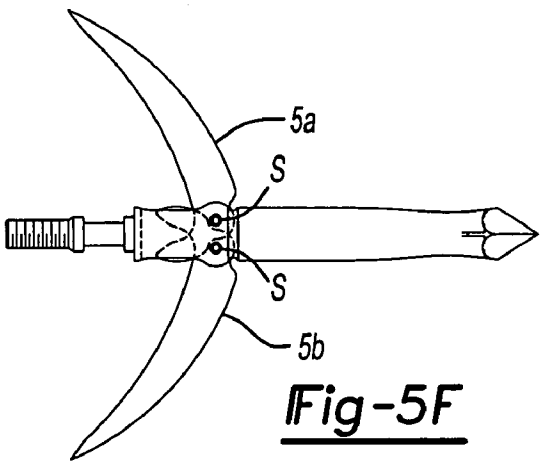
Figure 5E:
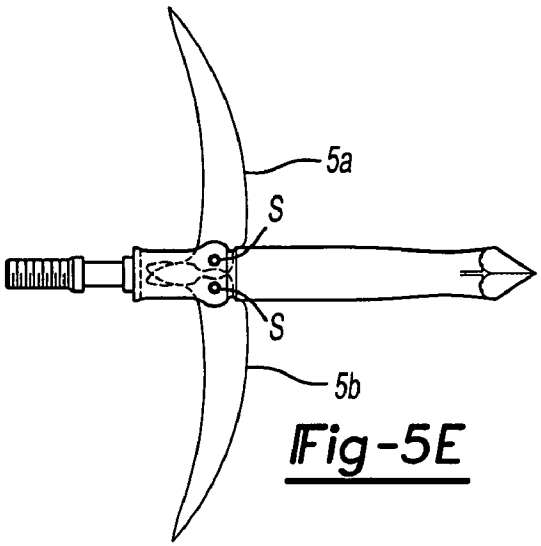
Figure 5D:
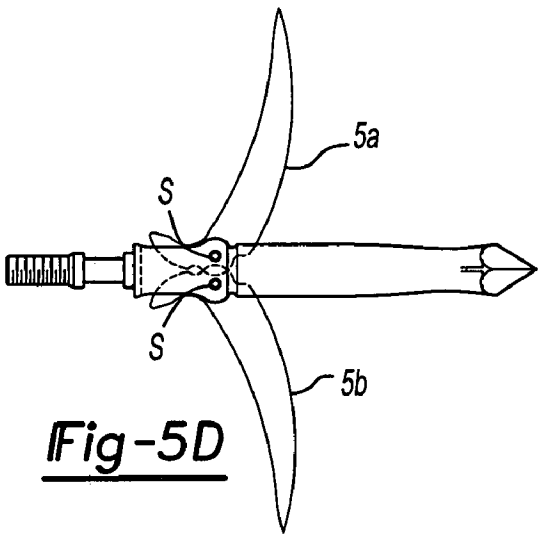

The blades are curved and shaped on an arch with very sharp leading edges and a J-shaped lever. The blades each have one hole in them for location and pivot and the rest of the shape is made with multiple complex curves. Two blades are used in each broadhead. The blades have a constant thickness of currently 0.030"-0.032" of an inch and are either blanked or lasered from sheet stock. As seen in FIG. 2. the blades are designed with complex curves and radii that add strength and specific function to the broadhead. They are made from a 300 series stainless steel alloy and are tempered to give a secure balance between hardness and ductility. The blades are sharpened along one curved edge 2*a* to razor sharpness. This curved edge requires a special sharpening process, which straight blades do not. The sharpened curved edge is exposed, or protrudes from the body, as seen in FIG. 5*a*, when in the fully closed position. At the rear of the blade is a through-hole 2*b*. This hole is the mounting point, as well as the pivot point for the blades as fastened to the body utilizing the fasteners S. On either side of the mounting hole are two radii 2*c* and 2*d* that will come in contact with the opposing blades mounting fastener. Radius 2*d* contacts the opposing blades fasteners in the closed position. Radius 2*c* contacts the opposing blades fasteners in the full open position, as seen in FIG. 5F. The blade also incorporates a J-shaped lever 2*e* that acts as the final deploying mechanism. The lever 2*e* is unsharpened and also incorporates a hooking radius on its leading edge 2*f*. As shown in FIG. 2 and 2*a*, the forward-most portion of the lever 2*e* is not further forward than the forward-most portion of the through-hole 2*b* illustrated by line 20. Therefore, any tendency for the actuating levers to create a wedging action is extremely minimized. This lever is exposed in the closed (or flight) position and retained within the bodies slot 1*c* in the open position. In the closed position, the tip of the blade 2*g* is completely hidden within the tip of the body and has a positive stop 1*e* to insure the blade tips do not cross and become hooked together. The blades will be examined for potential upgrade in strength if they can be made stronger, sharper, thinner, lighter, and more cost effective. Minor changes in material, geometry, sharpening of the J levers, hole sizes and lever ratios may be incorporated; however, the main geometry and design intent of the anti-wedging design of the part will stay the same.

The O-ring R helps hold the blades in only for handling and premature deployment. The O-ring R is currently made from neoprene rubber. The O-ring's purpose is to give pressure to each of the blades when in the fully closed position. The O-ring R is under tension and locates in the groove G of the body. The O-ring R can be replaced/retrofitted with a variety of products. Some examples are; small rubber bands, shrink tubing, hose, string and/or a tape substance. A custom fitted proprietary retainer is not out of the question for the future. If there is something better than what we are using, the option for modification exists.

The set screws S retain, act as pivot points, and act as stop points for the blades in both closed and full open positions. The set screws S are currently made from a black phosphate coated steel alloy, are #2-56 and are fully threaded with an internal hex drive to facilitate attachment to the body 1*f*. Two are utilized per broadhead assembly. The set screws S provide three main functions: (1) They are the pivot point for the blades. (2) They function as blade travel limiting stops for full open and full closed, as seen in FIG. 5A, using the two radii 2*c* and 2*d* on the blades. (3) Since they fasten perpendicular to and traverse the area of the body that contains the slot 1*f*, they provide support for the main body of the broadhead. These are over-the-counter items people can find almost anywhere. The material, style and thread size of the set screws may change. It may become necessary to make these fasteners longer or shorter, non-threaded, partially threaded vs. fully threaded and/or harder or softer.

The two blades are attached to the body via the set screws S. Each blade is positioned into the body so that the J lever is protruding out the same side as the set screw that holds it in place, i.e., looking at the assembled broadhead in plan view, the left blade is located within the body using the left set screw S. Conversely, the right blade is held on the body using the right set screw S. The tips of the blades 2*g* are also oriented to stay on the side of the setscrews and J lever. The blade tips are held on their own side by both the opposing blades set screw and the limiting tab, i.e., inside the body. The O-ring R is slid onto the broadhead starting at the tip with the blades in the closed position. It is slid back until it locates itself into the O-ring groove G. Alternative variations of the broadhead are sizes/weights. The main body and its geometry does not change much, it only gets shorter in total length and/or smaller in diameter in relation to the shorter/longer blades. Behind the tip, almost right at the front of the slot and on the main body approximately half way from the O-ring to the tip there is a small tangent 1*j* where two different angles meet. It is in this rearward half of the body where the length difference would take place. As for the blades, they get shorter/longer as the bodies get shorter/longer. However, the rear portion and its anti-wedging geometry stay the same.

The broadhead is attached to any AMO standard arrow shaft and is designed to be used in bow hunting for harvesting game of various sizes. The broadhead works on a "penetrate first and deploy the blades second" operation. The tip is sharp to a point with four concave facets and cutting surfaces. The tip is larger than most of the main body which provides less friction for deeper penetration. As the broadhead enters a low-density object (such as animal flesh), the tip makes contact and creates four cuts to allow the rest of the broadhead to penetrate. Next, the exposed blades protruding from the broadheads slot make contact with the target and continue the cutting process while at the same time being forced into the body and out the other side. As the exposed portion of the blade pivots in towards the body, the same blade tip starts to expose itself on the opposite side of the broadhead. This is the primary initiation of blade deployment of this design. Due to the design's inboard center-of-gravity blade geometry, deceleration in the target also causes the blade tips to expose and start deployment. As the broadhead continues penetration, the J levers make contact with the target and through a lever motion, forces the blades to further deploy. Forward motion and target resistance continues the opening of the blades until they reach their stops. The curved cutting surface of the broadhead further insures conservation of forward momentum and flight path. The farther the cutting surface of the blades is from the centerline of the body, the more parallel the cutting action becomes. This is to facilitate a slicing, rather than chopping action of the blades. In a hard target scenario, such as hitting bone just below the surface of the hide, the broadhead's tip penetrates, encounters bone, creates four fracture lines, folds and chips the hard mass forward and to the side and creates a cavity for the rest of the broadhead to pass through with relative ease. As the broadhead continues passing through bone the J levers at the very rear of the blades encounter resistance from the surface of the bone not broken by the tip and complete deployment of the blades. The blades are actuated from the rear of the broadhead and the blades deploy from inside the tip. This allows the broadhead to have already penetrated the bone and deploy the blades well after penetration. The design goes a step further by incorporating an anti-wedging geometry. Anti-wedging geometry is the ability of the broadhead to penetrate the target's hard components (such as bone, plywood, etc. targets) in such a way as to punch a hole or cavity with the tip, creating a cavity with the same or larger dimensions than the major diameter of the tip itself. The body then tapers down to a smaller diameter behind this tip. This allows conservation of kinetic energy after the initial pass-through cavity is created. While firing into a target, after the initial penetration is accomplished, the broadhead will penetrate to a depth of at least four times its major body diameter before the rear J levers encounter any physical resistance (the 125 grain version shown here has a penetration ratio greater than 5:1). Primary and/or partial blade deployment is accomplished thusly; the exposed portion of the blades (while encountering any resistance from the target and are located within the main body slot) initiates primary deployment by moving its cutting tip outside of the main body from the opposite side and/or from deceleration of the arrow causing the blades to seek their natural center-of-gravity which exposes the blade tips. Secondary and/or final deployment is achieved once the rear J levers encounter resistance from the target; the curved blades (which the trip levers are integral to) begin deployment starting from the front (within the tip area) of the broadhead. The design intent is to have the main blades deploy after a minimum of a 4:1 diameter-to-depth penetration ratio as well as not to have any wedging action caused by the geometry of the J levers deploying the blades within the cavity produced by the initial penetration of the tip. This design allows the body of the broadhead, while deploying the blades, to pass through a hole created by the tip, through a hard object (such as bone, plywood, etc.). For example, this broadhead can pass through a ½" hole in ¼" thick material while deploying the blades without blade wedging interference and subsequent energy loss. This pass-through feature, without wedging in the hole created by the tip and controlling blade deployment until well into the target is the main component of this design and of conserving kinetic energy. This conservation of energy now allows for use of lower poundage bows and/or better target penetration with existing bows. This broadhead also has attributes that make it very resistant to deflecting and catapulting off the target. First attribute: The broadhead has a designed-in greater than 4:1 diameter-to-depth penetration ratio, even an off axis shot can be self-correcting with this design. This is due to the broadheads ability to penetrate considerably and gain a deep anchor in the target before deflecting and/or catapulting leverage forces can have significant impact on flight path. This ability to penetrate without encountering deflection forces from exposed blades and mechanisms helps greatly to create a clean guide path for the rest of the broadhead and arrow. Second attribute: As the broadhead penetrates, whichever J lever/blade is closest to the target during entry is the one to start the deployment sequence first. Since this action will deploy the start of cutting actions on the part of the blade, a portion of forward kinetic energy is diverted into said blade and consequently alters the force vector towards a more desirable perpendicular path. However, this action (as seen in other broadhead designs) could, in some circumstances, create catapulting forces that would divert the broadhead/arrow assembly off of its desired path. This broadhead gets around this issue with another innovation, namely, Inboard Center of Gravity. Since the blade/J lever's center of gravity is inside of the pivot point, deceleration (as occurs when hitting the target) actually aids in deployment of the outside blade (without intervention of that blade's J lever) and consequently self-corrects the catapulting forces that would affect other designs to date. This same center of gravity advantage keeps the blades tucked tightly inside of the body during acceleration (such as releasing the arrow from the bow). Third attribute: The problem with all other lever style mechanical broadheads to date is that they have the pivot point of their blade mechanism far behind the leading edge of the tripping portion. Or said another way, they have their trip levers in front of the pivots. This undesirable characteristic actually aids in catapulting the penetrating tip away from the target (as well as causing wedging energy loss) and uses the kinetic energy to deflect the broadhead parallel to the target. This broadhead exposes a dagger style curved blade tip that aids in anchoring the current flight path while the other designs act more like a pole vault, deflecting the broadhead up and out of the target. This broadheads blade pivot surface is in line or in front of the blades final actuating levers. The broadhead also uses the opposing blades pivot point as a stop point for both the fully open positions as well as the fully closed positions. When the blades are fully deployed and encountering objects in the target that would try to force the blades beyond design intent, the pivot pins/screws would be under extreme shearing forces if not for the opposing blade stops holding the pins/screws in compression.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An arrowhead for a broadhead arrow comprising:

an elongated generally cylindrically shaped body having a forwardly projecting tip portion, said body being provided with a diametrically extending through-slot, a pair of cutting blades pivotally mounted on said body and being movable about spaced parallel pivot axes between a retracted position disposed substantially within said through-slot, and a deployed position extending outwardly from said body, each of said cutting blades having an actuating lever projecting outwardly from said body when the associated of said blades is in its retracted position; and at least a portion of the pivot axis of each of said blades being located longitudinally closer to said tip portion of said body than the associated of said actuating levers, and the center of gravity of each of said cutting blades being disposed laterally inwardly from the associated of said pivot axis, whereby said cutting blades are retained in the respective retracted positions during acceleration of the arrow and moved toward their respective deployed positions upon deceleration of the arrow.

2. The invention as set forth in claim 1 wherein, said body further comprises major and minor diameter portions, and wherein the pivotal axis of each of said cutting blades is disposed no further forward of said body than said major diameter portion thereof.

3. The invention as set forth in claim 1 wherein, said actuating lever projects outwardly from one side of said body and a cutting edge projects outwardly from the opposite side of said body when each said cutting blade is disposed in its retracted position, whereby said cutting blades move from said retracted position toward said deployed position first by engagement of the cutting edges thereof with the target and then by engagement of the actuating levers thereof with the target.

4. The invention as set forth in claim 1 wherein, said body comprises major and minor diameter portions, wherein:

the pivotal axis of each of said cutting blades is disposed no further forward of said body than said major diameter portion thereof, wherein said actuating lever projects outwardly from one side of said body and a cutting edge projects outwardly from the opposite side of said body when each said cutting blade is disposed in its retracted position, whereby said cutting blades move from said retracted position toward said deployed position first by engagement of the cutting edges thereof with the target and then by engagement of the actuating levers thereof with the target, and wherein, the center of gravity of each of said cutting blades is disposed laterally inwardly from the associated of said pivot axis, whereby said blades are retained in the respective retracted positions during acceleration of the arrow and moved toward their respective deployed positions upon deceleration of the arrow.

5. The invention as set forth in claim 1 wherein, the center of gravity of each of said cutting blades is disposed laterally inwardly from the associated of said pivot axis, whereby said cutting blades are retained in the respective retracted positions during acceleration of the arrow and moved toward their respective deployed positions upon deceleration of the arrow, wherein said body comprises a major diameter portion, and wherein the pivotal axis of each of said cutting blades is disposed no further forward of said body than the major diameter portion thereof.

6. The invention as set forth in claim 1 wherein, said body comprises a major diameter portion and the pivotal axis of each of said cutting blades is disposed no further forward of said body than said major diameter portion thereof, wherein said actuating lever projects outwardly from one side of said body and a cutting edge projects outwardly from the opposite side of said body when said cutting blades are disposed in their respective retracted position, whereby said cutting blades move from said retracted position toward said deployed position first by engagement of the cutting edges thereof with the target and then by engagement of the actuating levers thereof with the target.

7. The invention as set forth in claim 1 wherein, the center of gravity of each of said cutting blades is disposed laterally inwardly from the associated of said pivot axis, whereby said cutting blades are retained in the respective retracted positions during acceleration of the arrow and moved toward their respective deployed positions upon deceleration of the arrow, and wherein said actuating lever of each of said cutting blades projects outwardly from one side of said body and an associated cutting edge projects outwardly from the opposite side of said body when said each cutting blade is disposed in its respective retracted position.

8. The invention as set forth in claim 1 wherein, said body is fabricated of an anodized aluminum alloy to provide a relatively hard and low friction external surface.

9. The invention as set forth in claim 1 wherein, said tip portion comprises at least two circumferentially spaced cutting edges, wherein said through-slot is aligned with said two cutting edges, such that upon penetration of said tip portion into a target, said cutting edges create fracture lines in the target which are aligned with the plane of movement of the cutting blades from their respective retracted to deployed positions.

10. The invention as set forth in claim 1 wherein, said cutting blades comprise cutting edges that are forwardly convex and arcuate in shape and which at least partially project from the sides of said body in their respective retracted positions to provide a cutting action directly rearwardly of said tip portion and to initiate deployment of said cutting blades out of the sides of said through-slot.

11. The invention as set forth in claim 1 wherein, said cutting blades are operatively disposed on said body in a manner so as to provide for limited movement of said cutting blades axially of their respective pivot axis, whereby the arrow is able to seek the path of least resistance as it penetrates the target.

12. The invention as set forth in claim 1 wherein, said cutting blades are pivotally mounted by means of pivot pins secured to said body, and wherein each cutting blade utilizes the pivot pin of the opposing blade as means for limiting movement toward its retracted and deployed positions.

13. The invention as set forth in claim 1 wherein, said body comprises a forward tip portion of a first diameter and a body portion disposed rearwardly of said tip portion of a second diameter, and wherein said first diameter is greater than said second diameter so that after penetration of the tip portion into a target, the rest of the body can pass into said target with reduced resistance.

14. The invention as set forth in claim 1 wherein, said cutting blades are pivotally mounted within and adjacent the rearward end of said through-slot, and which includes means within the forward end of said through-slot to ensure the tips of said cutting blades do not cross and become locked together.

15. The invention as set forth in claim 1 which includes a ring-shaped elastomeric element disposed around said body and said cutting blades to assure against premature deployment of said cutting blades.

16. The invention as set forth in claim 1 wherein, said body comprises a major diameter portion, and wherein the axial dimension between the forward end of said tip portion and said actuating levers on said cutting blades is approximately four to five times the major diameter of said body, whereby to permit the desired target penetration of the body portion preparatory to full deployment of said cutting blades.

17. The invention as set forth in claim 1 wherein, said tip portion and said body portion comprise separate assembled components.

18. An arrowhead adapted to be operatively associated with an arrow and comprising:

a body having a diametrically extending through-slot, a pair of retractable cutting blades disposed within said through-slot and being independently movable between retracted and deployed positions, means defining a pair of laterally spaced parallel pivot axes arranged generally perpendicular to said through-slot and about which said cutting blades are pivotable between said retracted and deployed positions, the center of gravity of each of said blades being disposed laterally inwardly from the associated of said pivot axis, whereby said cutting blades are retained in the respective retracted positions during acceleration of the arrow and moved toward their respective deployed positions upon deceleration of the arrow.

19. The invention as set forth in claim 18 wherein, each of said cutting blades comprises an actuating lever projecting outwardly from said body when the respective of said cutting blades is in its retracted position; and wherein, the pivot axis of each of said cutting blades is located longitudinally further from closer to the forward tip of the arrowhead than the associated of said actuating levers.

20. The invention as set forth in claim 18 wherein, said body comprises a major diameter portion, and wherein the pivot axis of each of said cutting blades is disposed no further forward of said body than said major diameter portion thereof.

21. The invention as set forth in claim 18 wherein, said actuating lever of each of said cutting blades projects outwardly from one side of said body and the associated cutting edge projects outwardly from the opposite side of said body when each said cutting blade is disposed in its retracted position, whereby said cutting blades move from said retracted position toward said deployed position first by engagement of the cutting edges thereof with the target and then by engagement of the actuating levers thereof with the target.

22. The invention as set forth in claim 18 wherein, each of said cutting blades comprises an actuating lever projecting outwardly from said body when the cutting blade is in its retracted position, wherein:

the pivot axis of each of said cutting blades is located longitudinally further from closer to the tip of the arrowhead than the associated of said actuating levers, wherein said body comprises a major diameter portion and wherein the pivotal axis of each of said cutting blades is disposed no further forward of said body than said major diameter portion thereof, and wherein said actuating lever of each of said cutting blades projects outwardly from one side of said body and the associated cutting edge projects outwardly from the opposite side of said body when said cutting blade is disposed in its retracted position.

23. The invention as set forth in claim 18 wherein, each of said cutting blades comprises an actuating lever projecting outwardly from said body when said cutting blade is in its retracted position, wherein:

the pivot axis of each of said cutting blades is located longitudinally further from closer to the tip of the arrowhead than the associated of said actuating levers, and wherein said body comprises a major diameter portion and wherein the pivotal axis of each of said cutting blades is disposed no further forward of said body than said major diameter portion thereof.

24. The invention as set forth in claim 18 wherein, each of said cutting blades comprises an actuating lever projecting outwardly from said body when said cutting blade is in its retracted position, wherein:

the pivot axis of each of said cutting blades is located longitudinally further from closer to the tip of the arrowhead than the associated of said actuating levers, and wherein said actuating levers project outwardly from one side of said body and the cutting edge of each cutting blade projects outwardly from the opposite side of said body when each said cutting blade is disposed in its retracted position, whereby said cutting blades move from said retracted position toward said deployed position first by engagement of the cutting edges thereof with the target and then by engagement of the actuating levers thereof with the target.

25. The invention as set forth in claim 18 wherein, said body comprises a major diameter portion, wherein:

the pivotal axis of each of said cutting blades is disposed no further forward of said body than said major diameter portion thereof, and wherein each of said cutting blades comprises actuating lever means projecting outwardly from one side of said body and cutting means projecting outwardly from the opposite side of said body when each said cutting blade is disposed in its retracted position.

26. The invention as set forth in claim 18 wherein, said body is fabricated of an anodized aluminum alloy to provide a relatively hard and low friction external surface.

27. The invention as set forth in claim 18 wherein, said body is formed with a tip portion comprising at least two circumferentially spaced cutting edges, and wherein the open sides of said through-slot are aligned with said two cutting edges, whereby said cutting edges are aligned with the plane of movement of said cutting blades from their respective retracted to deployed positions.

28. The invention as set forth in claim 18 wherein, said cutting blades comprise cutting edges that are forwardly convex in shape to provide a cutting action directly rearwardly of the tip of the arrowhead and to facilitate deployment of said blades out of the sides of said through-slot.

29. The invention as set for forth in claim 18 wherein, said cutting blades are operatively disposed on said body in a manner so as to provide for limited movement of said blades axially of their respective pivot axis, whereby the arrow is able to seek the path of least resistance as it penetrates the target.

30. The invention as set forth in claim 18 wherein, said cutting blades are pivotally mounted on pivot means and wherein each cutting blade utilizes the pivot means of the opposing cutting blade as means for limiting movement toward its full retracted and full deployed positions.

31. The invention as set forth in claim 18, wherein said body comprises a tip portion of a first diameter, and a body portion disposed rearwardly of said tip portion has a second diameter, and wherein said first diameter is greater than said second diameter so that after penetration of the tip portion into a target, the rest of the body can pass into said target with reduced resistance.

32. The invention as set forth in claim 18 wherein, said cutting blades are pivotally mounted within and adjacent the rearward end of said through-slot, and which includes means to prevent the cutting blades from crossing in their retracted positions.

33. The invention as set forth in claim 18 which includes a resilient means to assure against premature deployment of said cutting blades.

34. The invention as set forth in claim 18 wherein, the axial dimension between the forward end of said body and actuating levers on said cutting blades is at least four times the major diameter of said body.

35. The invention as set forth in claim 18 which includes a separate tip portion assembled on the forward end of said body.

36. An arrowhead for use with a broadhead arrow, said arrowhead comprising:

an elongated body having a forwardly projecting tip portion and major and minor diameter portions, said body having a longitudinally extending through-slot formed therein, a pair of cutting blades, each of said blades having an actuating lever and being pivotally mounted on by means of a pivot element disposed within a pivot bore formed in said body, whereby said cutting blades are and being pivotable between a first position substantially retracted within said through-slot and a second position wherein the cutting edges of said cutting blades are deployed outwardly from said body, the furthest forward position of said actuating levers being no further forward than the forward-most portion of the associated said pivot element bores, the pivotal axis of each of said cutting blades being disposed no further forward of said body than said major diameter portion thereof, wherein, the center of gravity of each of said cutting blades is disposed laterally inwardly from the associated of said pivot axis, whereby said cutting blades are retained in their respective retracted positions during acceleration of the arrow and move toward their respective deployed positions upon deceleration of the arrow.

37. The invention as set forth in claim 36 wherein, each of said cutting blades comprises an actuating lever projecting outwardly from said body when the respective of said cutting blades is in its retracted position, and wherein at least a portion of the pivot axis of each of said cutting blades is located longitudinally closer to said tip portion than the associated of said actuating levers.

38. The invention as set forth in claim 36 wherein, each of said cutting blades comprises actuating lever means projecting outwardly from one side of said body and a cutting edge projecting outwardly from the opposite side of said body when each said cutting blade is disposed in its retracted position.

39. The invention as set forth in claim 36 wherein, each of said cutting blades includes an actuating lever projecting outwardly from said body when the respective of said cutting blades is in its retracted position, wherein the pivot axis of each of said cutting blades is located longitudinally further from closer to said tip portion than the associated of said actuating levers, wherein the center of gravity of each of said cutting blades is disposed laterally inwardly from the associated of said pivot axis, and wherein each of said cutting blades has its respective actuating lever projecting outwardly from one side of said body and a cutting edge projecting outwardly from the opposite side of said body when each said cutting blade is disposed in its retracted position.

40. The invention as set forth in claim 36 wherein, each of said cutting blades comprises an integral actuating lever projecting outwardly from one side of said body and an associated cutting edge projecting outwardly from the opposite side of said body when each said cutting blade is disposed in its retracted position, and wherein:

the pivot axis of each of said cutting blades is located longitudinally further from said tip portion than the associated of said actuating levers.

41. The invention as set forth in claim 36 wherein, each of said cutting blades comprises a J-shaped actuating lever, wherein the pivot axis of each of said cutting blades is located longitudinally further from closer to said tip portion than the associated of said actuating levers, and wherein:

the center of gravity of each of said cutting blades is disposed laterally inwardly from the associated of said pivot axis, whereby said cutting blades are retained in the respective retracted positions during acceleration of the arrow and moved toward their respective deployed positions upon deceleration of the arrow.

42. The invention as set forth in claim 36 wherein the center of gravity of each of said cutting blades is disposed laterally inwardly from the associated of said pivot axis, and wherein each of said cutting blades comprising actuating lever means projecting outwardly from one side of said body and a cutting edge projecting outwardly from the opposite side of said body when each said cutting blade is disposed in its retracted position, whereby said cutting blades move from said retracted position toward said deployed position first by engagement of the cutting edges thereof with the target and then by engagement of the actuating levers thereof with the target.

43. The invention as set forth in claim 36 wherein, said body is fabricated of a metal alloy having a relatively hard and low friction external surface.

44. The invention as set forth in claim 36 wherein, said tip portion comprises at least two circumferentially spaced cutting edges, wherein said through-slot is aligned with said two cutting edges, whereby said cutting edges are aligned with the plane of movement of the cutting blades from their respective retracted to deployed positions.

45. The invention as set forth in claim 36 wherein, the cutting edges of said cutting blades are forwardly convex and arcuate in shape to provide a cutting action directly rearwardly of said tip portion.

46. The invention as set forth in claim 36 wherein, said cutting blades are operatively disposed on said body in a manner so as to provide for limited movement of said cutting blade axially of their respective pivot axis.

47. The invention as set forth in claim 36 wherein, said cutting blades are each mounted on a pivot element, and wherein each cutting blade utilizes the pivot element of the opposing cutting blade as means for limiting movement toward at least one of the full retracted or full deployed positions.

48. The invention as set forth in claim 36 wherein, said tip portion has a first diameter and said body has a second diameter portion located rearwardly of such tip portion, and wherein said first diameter is greater than said second diameter so that after penetration of the tip portion into a target, the rest of the body can pass into said target with reduced resistance.

49. The invention as set forth in claim 36 wherein, said cutting blades are pivotally mounted within and adjacent the rearward end of said through-slot, and which includes stop means within the forward end of said through-slot to limit movement of said cutting blades.

50. The invention as set forth in claim 36 which includes means disposed around said body and said cutting blades to assure against premature deployment of said cutting blades.

51. The invention as set forth in claim 36 wherein, the axial dimension between the forward end of said tip portion and actuating means on each of said cutting blades is approximately four to five times the major diameter of said body.

52. The invention as set forth in claim 36 wherein, said tip portion and said body comprise separate assembled components.

53. In combination in a broadhead arrow, an arrowhead assembly comprising a longitudinally disposed body having a forwardly projecting tip portion and rearward mounting portion adapted to be operatively secured to the shaft of the arrow, said body being provided with a diametrically extending through-slot, a pair of cutting blades pivotally mounted within said through-slot of said body and each being movable about a respective pivot axis between a retracted and deployed position, each of said cutting blades comprising actuating lever means projecting outwardly from one side of said body and a cutting edge projecting outwardly from the opposite side of said body when each said cutting blade is disposed in its retracted position.

54. The invention as set forth in claim 53 wherein, the pivot axis of each of said cutting blades is located longitudinally further from closer to said tip portion than the associated of said actuating levers.

55. The invention as set forth in claim 53 wherein, the center of gravity of each of said cutting blades is disposed laterally inwardly from the associated of said pivot axis, whereby said cutting blades are retained in the respective retracted positions during acceleration of the arrow and moved toward their respective deployed positions upon deceleration of the arrow.

56. The invention as set forth in claim 53 wherein, said body comprises a major diameter portion, and wherein the pivotal axis of each of said cutting blades is disposed no further forward of said body than said major diameter portion thereof.

57. The invention as set forth in claim 53 wherein the actuating lever of at least one of said cutting blades is located longitudinally closer to said tip portion than the associated of said pivot axis, wherein the center of gravity of each of said cutting blades is disposed laterally inwardly from the associated of said pivot axis, and wherein, the pivotal axis of each of said cutting blades is disposed no further forward of said body than the major diameter portion thereof.

58. The invention as set forth in claim 53 wherein, each actuating lever is pivotally supported by a pivotal element disposed in a pivotal element bore in said body, wherein the furthest forward portion of each of said actuating levers is no further forward than the forward-most portion of the associated bore for the pivot element for each of said actuating levers, wherein the actuating levers of each of said cutting blades is located longitudinally closer to said tip portion than the associated of said pivot axis, and wherein the center of gravity of each of said cutting blades is disposed laterally inwardly from the associated of said pivot axis, whereby said cutting blades are retained in the respective retracted positions during acceleration of the arrow and moved toward their respective deployed positions upon deceleration of the arrow.

59. The invention as set forth in claim 53 wherein, the actuating levers of each of said cutting blades is located longitudinally closer to said tip portion than the associated of said pivot axis, and wherein the center of gravity of each of said cutting blades is disposed laterally inwardly from the associated of said pivot axis.

60. The invention as set forth in claim 53 wherein, the center of gravity of each of said cutting blades is disposed laterally inwardly from the associated of said pivot axis, wherein the pivotal axis of each of said cutting blades is disposed no further forward of said body than the major diameter portion thereof.

61. The invention as set forth in claim 53 wherein, said body is fabricated of an anodized aluminum alloy taken from the group of 6061-T6 and 7075-T6, and wherein said body is Type III anodized.

62. The invention as set forth in claim 53 wherein, said tip portion is formed with four equally circumferentially spaced cutting edges, wherein said through-slot is aligned with two of said cutting edges whereby the planes of movement of said cutting blades between said retracted and deployed positions are substantially aligned with said two cutting edges.

63. The invention as set forth in claim 53 wherein said cutting blades are formed with forwardly convex and arcuate cutting edges which provide a cutting action directly rearwardly of said tip portion and initiate deployment of said cutting blades out of said through-slot.

64. The invention as set for forth in claim 53 wherein, said cutting blades are relatively loosely secured to said body, whereby the arrow is able to seek the path of least resistance as it penetrates the target.

65. The invention as set forth in claim 53 wherein, said cutting blades are pivotally supported on pivot elements secured to said body, and wherein at least one of said cutting blades utilizes the pivot element of the opposing cutting blade as means for limiting pivotal movement thereof.

66. The invention as set forth in claim 53 wherein, said tip portion is of a first diameter and a portion of said body disposed directly rearwardly of said tip portion is of a second diameter, and wherein said first and second diameters are different to facilitate target penetration.

67. The invention as set forth in claim 53 which includes means within the forward end of said through-slot to limit movement of said cutting blades.

68. The invention as set forth in claim 53 which includes an 0-ring disposed around a groove formed in said body and around both of said cutting blades to assure against premature deployment of said cutting blades.

69. The invention as set forth in claim 53 wherein, the axial dimension between the forward end of said tip portion and the actuating levers on said cutting blades is greater than two times the major diameter of said body.

70. The invention as set forth in claim 53 wherein, said tip portion and said body comprise separate assembled components fabricated of different materials.

* * * * *

UNITED STATES PATENT AND TRADEMARK OFFICE

CERTIFICATE OF CORRECTION

PATENT NO. : 7,377,869 B2
APPLICATION NO. : 10/989938
DATED : May 27, 2008
INVENTOR(S) : Bryan J. Wohlfeil et al.

It is certified that error appears in the above-identified patent and that said Letters Patent is hereby corrected as shown below:

Title Page, item (57), Abstract, line 12, "insure" should be --ensure--

Col. 1, line 29, "Spiffire" should be --Spitfire--

Col. 3, line 61, "insure" should be --ensure--

Col. 6, line 55, "not" should be --no--

Col. 6, line 62, "insure" should be --ensure--

Col. 8, line 12, "insures" should be --ensures--

Col. 12, line 50, claim 19, delete "further from"

Col. 13, line 6, claim 22, delete "further from"

Col. 13, line 22, claim 23, delete "further from"

Col. 13, line 33, claim 24, delete "further from"

Col. 15, line 14, claim 39, delete "further from"

Col. 15, line 35, claim 41, delete "further from"

Col. 16, line 52, claim 54, delete "further from"

Signed and Sealed this

Tenth Day of August, 2010

David J. Kappos

David J. Kappos
*Director of the United States Patent and Trademark Office*